US008801135B2

(12) United States Patent
Oki et al.

(10) Patent No.: US 8,801,135 B2
(45) Date of Patent: Aug. 12, 2014

(54) LIQUID EJECTING APPARATUS AND LIQUID EJECTING METHOD

(71) Applicant: Seiko Epson Corporation, Tokyo (JP)

(72) Inventors: Narihiro Oki, Matsumoto (JP); Satoshi Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/960,652

(22) Filed: Aug. 6, 2013

(65) Prior Publication Data

US 2013/0321506 A1 Dec. 5, 2013

Related U.S. Application Data

(63) Continuation of application No. 13/015,454, filed on Jan. 27, 2011, now Pat. No. 8,550,586.

(30) Foreign Application Priority Data

Jan. 29, 2010 (JP) ..... 2010-019156

(51) Int. Cl.
*B41J 29/38* (2006.01)
*B41J 23/00* (2006.01)

(52) U.S. Cl.
USPC ..... 347/14; 347/37

(58) Field of Classification Search
USPC ..... 347/14, 37
See application file for complete search history.

(56) References Cited

U.S. PATENT DOCUMENTS 6,991,327 B2 * 1/2006 Goto et al. ..... 347/96

FOREIGN PATENT DOCUMENTS

| | | |
|---|---|---|
| JP | 2000-71540 | 3/2000 |
| JP | 2005-074696 | 3/2005 |
| JP | 2005-319635 | 11/2005 |

* cited by examiner

*Primary Examiner* — Uyen Chau N Le
*Assistant Examiner* — Kajli Prince
(74) *Attorney, Agent, or Firm* — Workman Nydegger

(57) ABSTRACT

A liquid ejecting apparatus includes a first carriage movement mode, in which a stop position of a carriage in movement of this time is determined to be at a given position in a width direction on the basis of a size in the width direction of a liquid-ejected medium, and a second carriage movement mode, in which the stop position of the carriage in the movement of this time is determined on the basis of at least one of the liquid ejection data in the movement of this time or the liquid ejection data in the movement of the next time, and liquid ejection is carried out with one of the first carriage movement mode and the second carriage movement mode selected in accordance with the type of liquid-ejected medium.

7 Claims, 7 Drawing Sheets

LIQUID EJECTING APPARATUS AND LIQUID EJECTING METHOD

This application is a Continuation of application Ser. No. 13/015,454, filed Jan. 27, 2011, and is expressly incorporated herein by reference. The entire disclosure of Japanese Patent Application No. 2010-019156, filed Jan. 29, 2010 is expressly incorporated by reference herein

BACKGROUND

1. Technical Field

The present invention relates to a liquid ejecting apparatus which includes a liquid ejecting head having nozzles and ejecting liquid from the nozzles onto a liquid-ejected medium on the basis of liquid ejection data, and a carriage carrying the liquid ejecting head and moving in the width direction of the liquid-ejected medium which is sent, and to a liquid ejecting method of the liquid ejecting apparatus.

In this application, in the liquid ejecting apparatus, recording apparatuses such as ink jet printers, line printers, photocopiers, and facsimiles shall be included. Here, in the line printer, for example, printers shall be included which each has a configuration in which rows of nozzles are provided to extend in a feed direction of the paper and a carriage having a recording head moves several times in the width direction of the paper when carrying out the recording.

2. Related Art

In the past, as shown in JP-A-2005-319635, a configuration has been made such that in the movement of the n-th time of a carriage, the stop position of the carriage is determined by considering the recording data in the movement of the next time, the (n+1)th time, of the carriage. Accordingly, it has been possible to minimize the loss of moving distance and the loss of moving time of the carriage when ink is not discharged. As a result, it has been possible to shorten the so-called throughput that is the required time from the start of the recording to the end of the recording per one sheet of paper.

However, if a stop position of the carriage is determined by considering the recording data in the movement of the next time, i.e., the (n+1)th time, of the carriage, there is a case where the carriage stops at a position where the nozzles formed in a recording head of the carriage face a side end of the paper. In such a case, there is a risk that powdery material such as paper dust, which is generated from the side end of the paper, adheres to the nozzles, so that poor discharge of ink in the nozzles occurs.

Shown in FIGS. 6A to 6C are diagrams showing adhesion amounts of the powdery material in the faces of recording heads 51 which are shown according to the stop positions of a carriage 50 which is considered by the invention. Of these, FIG. 6A is a schematic plan view showing a relationship between the row of nozzles of the recording head 51 and a side end (59 or 60) of paper 58.

Also, although two recording heads 51 are shown, actually, there are not two recording heads 51. This is for showing the positions of the respective recording heads 51, and actually, there is on only one recording head 51.

Also, FIG. 6B is a diagram showing the quantity of the powdery material on a face of the recording head 51 which has stopped at a position where the left side end 59 of the paper 58 in FIG. 6A and the space between the rows of nozzles face each other. Meanwhile, the vertical axis represents the quantity of the powdery material. On the other hand, the horizontal axis represents a position in a width direction on a face of the recording head 51. Further, FIG. 6C is a diagram showing the quantity of the powdery material on a face of the recording head 51 which has stopped at a position where the center of the paper 58 in FIG. 6A and the rows of nozzles face each other. The vertical axis and the horizontal axis are the same as those in FIG. 6B.

As shown in FIG. 6A, the recording head 51 is held by the carriage 50 and is provided so as to be able to move in a width direction with respect to a feed direction of the paper 58. Also, a total of six rows of nozzles (52 to 57), an A row to an F row in order from the left side, are formed in the recording head 51.

For example, as shown in FIG. 6A, the paper 58 is sent to the downstream side in the feed direction in a state where the recording head 51 has stopped at a position where the left side end 59 of the paper 58 and the space between the C row of nozzles 54 and the D row of nozzles 55 of the recording head 51 face each other. FIG. 6B shows an amount of the powdery material adhering to a face of the recording head 51 in such a case.

Also, the paper 58 is sent to the downstream side in the feed direction in a state where the recording head 51 has stopped at a position where the center of the paper 58 and the A row of nozzles 51 to the F row of nozzles 57 of the recording head 51 face each other. FIG. 6C shows an amount of the powdery material adhering to a face of the recording head 51 in such a case.

As shown in FIG. 6B, the adhesion amount of the powdery material such as paper dust in the space between the C row of nozzles 54 and the D row of nozzles 55, which faces the left side end 59 of the paper 58, is significantly large.

This is believed to be because slight vibrations are generated due to the sending of the paper 58, whereby paper dust is generated in the side end of the paper 58, and the generated paper dust is scattered up, thereby adhering to a face of the recording head 51. Also, the manner of distribution of the adhesion amount of the powdery material is considered to be close to a Gaussian distribution.

Also, as shown in FIG. 6C, the adhesion amount of the powdery material in the recording head 51 which faces the center of the paper 58 is very small compared to the case of FIG. 6B. This is believed to be because it is difficult for the powdery material such as paper dust to generate in the center of the paper 58, so that the adhesion amount to a face of the recording head 51 is small.

Also, a case where the paper 58 is sent to the downstream side in the feed direction in a state where the recording head 51 has stopped at a position where the right side end 60 of the paper 58 and the nozzle face of the recording head 51 face each other is the same as the case of a position where the left side end 59 and the nozzle face of the recording head 51 face each other. That is, there is a peak of distribution of the adhesion amount at a position which faces the side end. Since an amount and distribution of the powdery material adhering to a face of the recording head 51 are the same as those in FIG. 6B, illustration of the distribution is omitted.

From these points, it is understood that slight vibrations are generated due to the sending of the paper 58, whereby paper dust is generated in the side ends (59 and 60) of the paper 58, and the generated paper dust is scattered up, thereby adhering to a face of the recording head 51.

Also, shown in FIGS. 7A and 7B are sectional front views showing outlines of the structures of photographic paper and plain paper, each of which is an example of the liquid-ejected medium. Of these, FIG. 7A shows the photographic paper. On the other hand, FIG. 7B shows the plain paper.

As shown in FIG. 7A, photographic paper 61 has a front face coating layer 62, an ink absorbing layer 63, a base layer 64, and a back face coating layer 65 in order from the surface toward the back face. The front face coating layer 62 and the back face coating layer 65 are formed by a coating process such that they become the outermost layers of the surface and the back face for adjustment of gloss or the like, prevention of occurrence of a scratch, or the like.

Also, the ink absorbing layer 63 is provided at the surface side of the base layer 64 in order to increase the amount of ink that is absorbed, thereby expanding the range capable of reproducing colors. Further, the base layer 64 is provided so as to become the core of the photographic paper 61. The base layer 64 of the photographic paper 61 is constituted with resin as its main constituent. Here, the "main constituent" means, in the case of a composition which is composed of a plurality of materials, the material with the highest percentage among the plurality of materials.

On the other hand, as shown in FIG. 7B, plain paper 66 has a base layer 67 containing pulp as its main constituent. In the case of the plain paper 66, besides pulp, for example, pigments such as calcium carbonate are added for the purpose of increasing the degree of whiteness. Further, for example, fillers (a filling agent) such as clay, talc, or calcium carbonate are added for the purpose of achieving opacity, smoothness, weight increase, or the like of the medium.

Here, the photographic paper 61 of FIG. 7A and the plain paper 66 of FIG. 7B are compared with each other. In the photographic paper 61, the base layer 64 has a configuration composed mainly of resin, whereas in the plain paper 66, the base layer 67 has a configuration composed mainly of pulp. Therefore, compared to the photographic paper 61, the base layer 67 of the plain paper 66 comes apart more easily. For this reason, it is understood that compared to a side end 68 of the photographic paper 61, on a side end 69 of the plain paper 66, the powdery material is more easily generated from a cross-sectional surface.

Also, in contrast to the photographic paper 61, in the plain paper 66, the base layer 67 is not subjected to a coating process. For this reason, a process to maintain the material constitution of the base layer, which is generated due to a coating process in the side end 68 of the photographic paper 61, cannot be obtained in the side end 69 of the plain paper 66. Therefore, it is understood that compared to the side end 68 of the photographic paper 61, in the side end 69 of the plain paper 66, the powdery material is more easily generated from a cross-sectional surface.

In this manner, the amount of generation of the powdery material in the side end of the medium is thought to greatly vary with the nature of each type of medium. Moreover, an amount of the powdery material adhering to a face of the recording head is thought to greatly vary with the nature of each type of medium.

SUMMARY

An advantage of some aspects of the invention is that it provides a liquid ejecting apparatus and a liquid ejecting method, in which a carriage movement mode is selected in consideration of the nature of each type of liquid-ejected medium.

According to a first aspect of the invention, there is provided a liquid ejecting apparatus including: a liquid ejecting head which has nozzles and ejects liquid from the nozzles onto a liquid-ejected medium on the basis of liquid ejection data; and a carriage which carries the liquid ejecting head and moves in the width direction of the liquid-ejected medium, wherein the liquid ejecting apparatus has a first carriage movement mode, in which the stop position of the carriage in the movement of this time (the n-th time) is determined to be at a given position in the width direction on the basis of the size in the width direction of the liquid-ejected medium regardless of the liquid ejection data in the movement of the next time (the (n+1)th time) of the carriage, and a second carriage movement mode, in which the stop position of the carriage in the movement of this time (the n-th time) is determined on the basis of at least one of the liquid ejection data in the movement of this time (the n-th time) and the liquid ejection data in the movement of the next time (the (n+1)th time) regardless of the size in the width direction of the liquid-ejected medium, and liquid ejection is carried out with either one of the first carriage movement mode or the second carriage movement mode selected in accordance with the type of liquid-ejected medium.

According to the first aspect of the invention, either one of the first carriage movement mode or the second carriage movement mode is selected in accordance with the type of liquid-ejected medium.

In the case of a medium in which powdery material is easily generated on a side end of the liquid-ejected medium, the first carriage movement mode is selected in which the stop position of the carriage is set to be a given position, thereby being, for example, a position where the side end and the nozzles do not face each other. As a result, it is possible to reduce the adhesion amount of the powdery material in the nozzles.

On the other hand, in the case of a medium in which powdery material is not easily generated, even if the stop position of the carriage is set to be a position where the side end and the nozzles face each other, there is little problem. In such a case, the second carriage movement mode is selected in which the case of the facing is acceptable. As a result, it is possible to shorten the throughput, compared to the case of the first carriage movement mode.

Here, the throughput means the required time from the start of liquid ejection to the end of liquid ejection per one sheet of liquid-ejected medium.

As a result, it is possible to prioritize either of a reduction in the possibility of the nozzles clogging or an emphasis on the throughput in accordance with the type of liquid-ejected medium. That is, it is possible to prioritize either of an emphasis on liquid ejection quality or an emphasis on the throughput, so that a liquid ejection suitable for the type of liquid-ejected medium can be carried out.

Also, how to determine the stop position of the carriage in the second carriage movement mode varies with whether the configuration is a so-called one-way pass configuration or a two-way pass configuration.

Here, the "one-way pass configuration" means a configuration in which liquid is ejected from the liquid ejecting head in either one of a forward path or a return path of movement in the width direction of the carriage. On the other hand, the "two-way pass configuration" means a configuration in which liquid is ejected from the liquid ejecting head in both the forward path and the return path of movement in the width direction of the carriage.

Then, in the case of the one-way pass configuration, the stop position of the carriage is determined on the basis of the liquid ejection data in the movement of this time. On the other hand, in the case of the two-way pass configuration, the stop position of the carriage is determined in consideration of both the liquid ejection data in the movement of this time and the liquid ejection data in the movement of the next time.

According to a second aspect of the invention, in the first aspect, in the case of a first type of medium in which the main constituent of a material of the liquid-ejected medium is pulp, the first carriage movement mode may be selected, and in the case of a second type of medium in which the main constituent of a material of the liquid-ejected medium is resin, the second carriage movement mode may be selected.

Here, the "main constituent" means, in the case of aggregate composition which is composed of a plurality of materials, the material with the highest percentage among the plurality of materials. In the case of being constituted by a single material, it is the single material.

According to the second aspect of the invention, in addition to the same working effects as those in the first aspect, the selection is performed in accordance with whether the medium is the first type of medium or the second type of medium. In a case where it is the first type of medium, since pulp is the main constituent, powdery material is more easily generated on a side end of the medium, compared to the second type of medium. Specifically, since pulp is the main constituent, pulp fibers comes apart in the side end of the medium, whereby powdery material is more easily generated. In particular, in the case of wood pulp derived from hardwood trees, since the cellulose fiber is short compared to the case of wood pulp derived from coniferous trees, powdery material is more easily generated. Further, the generated powdery material is thought to adhere to an end portion of the medium.

Also, in a case where pulp is the main constituent, for example, pigment such as calcium carbonate is added for the purpose of increasing the degree of whiteness. Further, for example, fillers (a filling agent) such as clay, talc, or calcium carbonate are added for the purpose of achieving opacity, smoothness, weight increase, or the like, of the medium. These additives are believed to be easily generated as powdery material in the end portion of the medium.

In such a case, in order to reduce the possibility of the nozzles clogging due to adhesion of the powdery materials to the nozzles, a configuration, in which the first carriage movement mode is selected, is especially effective.

On the other hand, in a case where the medium is the second type of medium, since resin is the main constituent, the powdery material is not easily generated in the end portion of the medium. This is because the molecular bond of resin does not come apart as with pulp fiber. In such a case, even if a stop position of the carriage is set to be a position where the side end and the nozzles face each other, there is little problem. Therefore, in such a case, a configuration, in which the throughput-oriented second carriage movement mode is selected, is especially effective.

According to a third aspect of the invention, in the first aspect, in the case of a third type of medium, in which a structure of the liquid-ejected medium does not have a coating layer, the first carriage movement mode may be selected, and in the case of a fourth type of medium, in which a structure of the liquid-ejected medium has a coating layer, the second carriage movement mode may be selected.

According to the third aspect of the invention, in addition to the same working effects as those of the first aspect, the selection is performed in accordance with whether the medium is the third type of medium or the fourth type of medium. In a case where it is the third type of medium, the medium easily comes apart in view of the structure thereof, compared to the fourth type of medium. This is because there is no adhering force which is generated due to a coating agent by a coating process.

In such a case, in order to reduce the possibility of the nozzles clogging due to the adhesion of the powdery material to the nozzles, a configuration, in which the first carriage movement mode is selected, is especially effective.

On the other hand, in a case where the medium is the fourth type of medium, since there is an adhering force which is generated due to a coating agent by a coating process, it is believed that it is more difficult for the powdery material to be generated. In such a case, even if the stop position of the carriage is set to be a position where the side end and the nozzles face each other, there is little problem. Therefore, in such a case, a configuration, in which the throughput-oriented second carriage movement mode is selected, is especially effective.

According to a fourth aspect of the invention, in any one of the first three aspects, the given position of the first carriage movement mode may be a position where the nozzles and the side end in the width direction of the liquid-ejected medium do not face each other.

According to the fourth aspect of the invention, in addition to the same working effects as those in any one of the first three aspects, it is possible to more reliably reduce the adhesion amount of the powdery material in the nozzles.

According to a fifth aspect of the invention, in any one of the first four aspects, in the case of a configuration in which liquid is ejected from the liquid ejecting head in a forward path and a return path of movement in the width direction of the carriage, in the second carriage movement mode, the stop position in the movement of this time (the n-th time) of the carriage may be determined on the basis of one position which is on the downstream side in a moving direction of this time (the n-th time) of the carriage by comparing the start position of liquid ejection of the next time (the (n+1)th time) with the end position of liquid ejection of this time (the n-th time), when the movement of the next time (the (n+1)th time) of the carriage is present in liquid ejection data, and in the case of a configuration in which liquid is ejected from the liquid ejecting head in one of a forward path and a return path of movement in the width direction of the carriage, in the second carriage movement mode, the stop position in the movement of this time (the n-th time) of the carriage may be determined on the basis of the end position of liquid ejection of this time (the n-th time) when the movement of this time (the n-th time) of the carriage is the movement in which liquid ejection is performed, and the stop position in the movement of this time (the n-th time) of the carriage may be determined on the basis of the start position of liquid ejection of the next time (the (n+1)th time) when the movement of this time (the n-th time) of the carriage is the movement in which liquid ejection is not performed and the movement of the next time (the (n+1)th time) of the carriage is present in the liquid ejection data.

According to the fifth aspect of the invention, in addition to the same working effects as those in any one of the first four aspects, even in any of all cases, it is possible to reduce losses of time and distance, in which the carriage moves without ejecting liquid, compared to the case of the first carriage movement mode.

According to a sixth aspect of the invention, there is provided a liquid ejecting method in a liquid ejecting apparatus, including: moving a carriage in the width direction of a liquid-ejected medium; and ejecting liquid from nozzles of a liquid ejecting head provided at the carriage onto the liquid-ejected medium in the movement process, wherein the method further has a first carriage movement mode which determines the stop position of the carriage in the movement of this time (the n-th time) to be at a given position in the width direction on the basis of the size in the width direction of the liquid-ejected medium regardless of the liquid ejection data in the movement of the next time (the (n+1)th time) of the carriage, and a second carriage movement mode which determines a stop position of the carriage in the movement of this time (the n-th time) on the basis of at least one of the liquid ejection data in the movement of this time (the n-th time) and the liquid ejection data in the movement of the next time (the (n+1)th time) regardless of the size in the width direction of the liquid-ejected medium, and includes selecting one of the first carriage movement mode and the second carriage movement mode in accordance with the type of liquid-ejected medium.

According to the sixth aspect of the invention, the same working effects as those in the first aspect can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described on the basis of the drawings.

Figure 1:
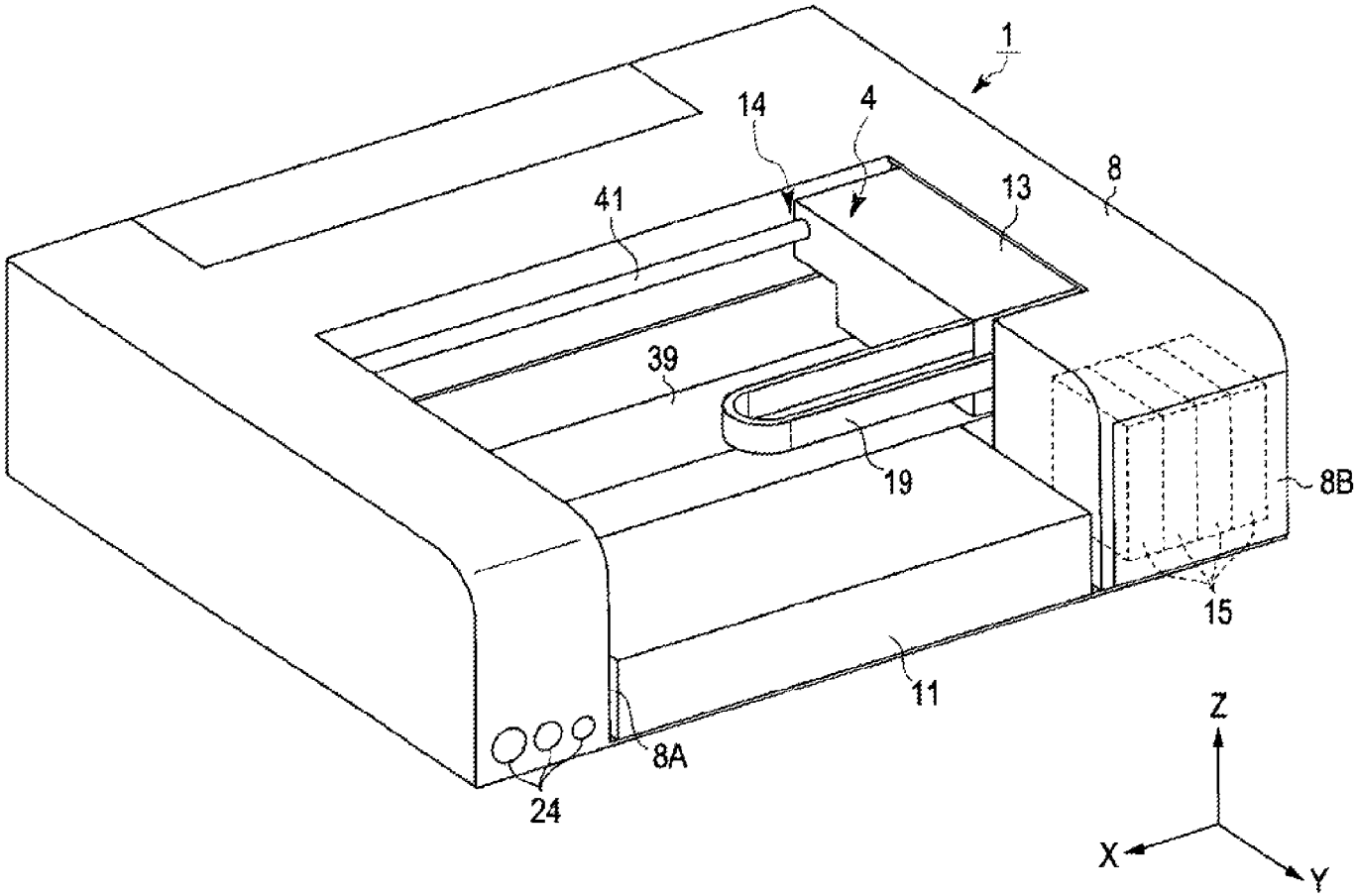
FIG. 1 is a perspective view showing the whole of a printer related to the invention.

Shown in FIG. 1 is a perspective view showing a printer as an image forming apparatus related to this embodiment.

As shown in FIG. 1, the printer 1 is a printer of a form which is thin in the Z-axis direction that is the height direction. Also, the printer 1 has a square box-shaped main body 8, and in the central area of the main body 8, a carriage 13 is provided so as to be guided on a carriage guide shaft 41, which is provided so as to extend along a right-and-left direction X (the main scanning direction (the width direction of the paper)) in FIG. 1, thereby being capable of moving back and forth in the main scanning direction.

Here, the carriage 13 is set to be constituted so as to be moved by a movement section 14. Specifically, the movement section 14 includes a first motor (not shown), a pair of pulleys (not shown), and an endless belt (not shown). The endless belt is wound around the pair of pulleys and a configuration is made such that the first motor drives one pulley of the pair of pulleys. Then, a configuration is made such that a portion of the endless belt is engaged with the carriage 13, whereby power is transmitted to the carriage 13.

As shown in FIG. 1, in the central area of the main body 8, a long plate-like medium support section 39 is disposed at a lower position, which faces the carriage 13, in a state where the longitudinal direction thereof is parallel to the main scanning direction X. At a lower portion of the front face (a face on a front side in FIG. 1) of the printer 1, a paper cassette 11 for paper feeding is mounted (inserted) in a mounted portion 8A of a concave shape, which is formed in the main body 8 such that the front face side is opened, in a state where the cassette can be inserted into and ejected from the mounted portion. Also, a plurality of pieces of ink cartridges 15 is loaded in the inside of a cover 8B which covers the front face of a right end portion of the main body 8.

Ink of the respective ink cartridges 15 is respectively supplied to the carriage 13 through a plurality of pieces of ink supply tubes (not shown) annexed to a flexible wiring plate 19, and ink droplets are ejected (discharged) from a recording head 7 (shown in FIG. 2) provided at a lower portion of the carriage 13. In addition, a pressurizing element (a piezoelectric element, an electrostatic element, a heat generation element, or the like) which provides pressure for ejecting ink to the ink is built for each row of nozzles in the recording head 7, and a configuration is made in which an ink droplet is ejected (discharged) from a corresponding nozzle by applying a given voltage to the pressurizing element.

At the time of printing, ink droplets are ejected from the recording head 7 in the process of moving in the main scanning direction along with the carriage 13, onto paper P, which is fed from the paper cassette 11 and located on the medium support section 39, whereby printing for one line is carried out. In this way, a printing operation by one scan of the carriage 13 and a paper transport operation to the subsequent line are alternately repeated, whereby printing on the paper P is progressed. Also, various operation switches 24 which include an electric power switch are provided at the lower portion of the left end front face of the main body 8.

Figure 2:
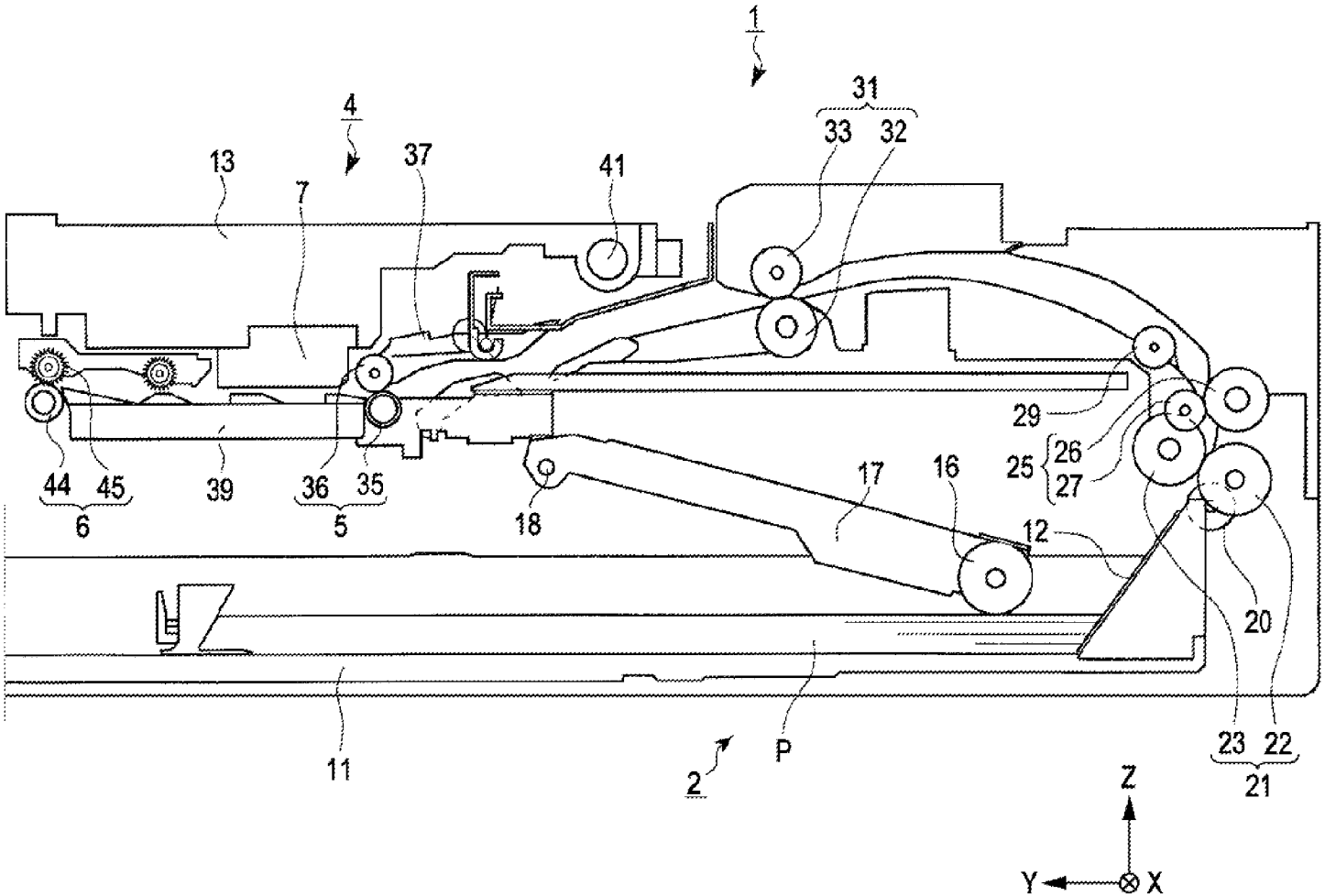
FIG. 2 is a sectional side view showing an outline of the inside of the printer related to the invention.

Shown in FIG. 2 is a sectional side view showing an outline of the inside of the printer related to the invention.

As shown in FIG. 2, the printer 1 has a configuration in which a feeder device 2 is provided at the bottom portion of the apparatus, the recording papers P are fed one by one from the feeder device 2, whereby ink jet recording is performed by a recording section 4, and then, the paper is discharged toward a paper discharge stacker (not shown) provided at the front side (the left side in FIG. 2) of the apparatus.

The feeder device 2 includes the paper cassette 11, a pickup roller 16, a guide roller 20, and a separator 21. The paper cassette 11, which can be accommodated in a state where a plurality of sheets of papers P are stacked, is constituted so as to be able to be mounted on and removed from the main body of the feeder device 2 from the front side of the apparatus. Also, the pickup roller 16 which is rotationally driven by a second motor (not shown) is provided at a shaking member 17 which shakes around a shaking shaft 18. Then, the pickup roller rotates in contact with the paper contained in the paper cassette 11, thereby sending out the topmost paper P from the paper cassette 11.

A separating member 12 is provided at a position which faces the leading end of the paper contained in the paper cassette 11. Then, the leading end of the topmost paper P, which should be fed, proceeds to the downstream side while coming into sliding contact with the separating member 12, whereby a first step separation from the second and subsequent papers P is performed. The freely rotatable guide roller 20 is provided at the downstream side of the separating member 12. Further, at the downstream side of the guide roller, the separator 21 is provided which is constituted to include a separating roller 22 and a driving roller 23 and performs a second step separation of the paper P.

At the downstream side of the separator 21, a first intermediate feed section 25 is provided which is constituted to include a driving roller 26 which is rotationally driven by the second motor (not shown), and an assistance roller 27 which nips the paper P between it and the driving roller 26, thereby being driven and rotated. Then, the paper P is sent to the further downstream side by the first intermediate feed section 25. Also, a reference numeral 29 denotes a driven roller which relieves the passing paper load when the paper P passes through a curved inversion path (in particular, when the rear end of the paper passes through).

At the downstream side of the driven roller 29, a second intermediate feed section 31 is provided which is constituted to include a driving roller 32 which is rotationally driven by the second motor (not shown), and an assistance roller 33 which nips the paper P between it and the driving roller 32, thereby being driven and rotated. Then, the paper P is sent further to the downstream side by the second intermediate feed section 31.

At the downstream side of the second intermediate feed section 31, the recording section 4 is disposed. The recording section 4 includes a transport section 5, the recording head 7, the medium support section 39, and a discharge section 6. The transport section 5 is constituted to include a transport driving roller 35 which is rotationally driven by the second motor (not shown), and a transport driven roller 36 which is supported by a shaft on an upper-side paper guide section 37 so as to be driven and rotated in pressure-contact with the transport driving roller 35. Then, the paper P is precisely sent toward a position, which faces the recording head 7, by the transport section 5.

The recording head 7 is provided at the bottom of the carriage 13 and the carriage 13 is driven so as to reciprocate in the main scanning direction by the movement section 14 such as the first motor (not shown) while being guided on the carriage guide shaft 41 which extends in the main scanning direction (the front-and-back direction with respect to the plane of paper in FIG. 2). The medium support section 39 is provided at a position which faces the recording head 7, and the distance between the paper P and the recording head 7 is defined by the medium support section 39.

The discharge section 6 provided at the downstream side of the medium support section 39 is constituted to include a discharge driving roller 44 which is rotationally driven by the second motor (not shown), and a discharge driven roller 45 which is driven and rotated in contact with the discharge driving roller 44. Then, the paper P, on which recording has been performed by the recording section 4, is discharged to a stacker (not shown) provided at the front side of the apparatus, by the discharge section 6.

Normal Recording Mode: First Carriage Movement Mode

Figure 3:
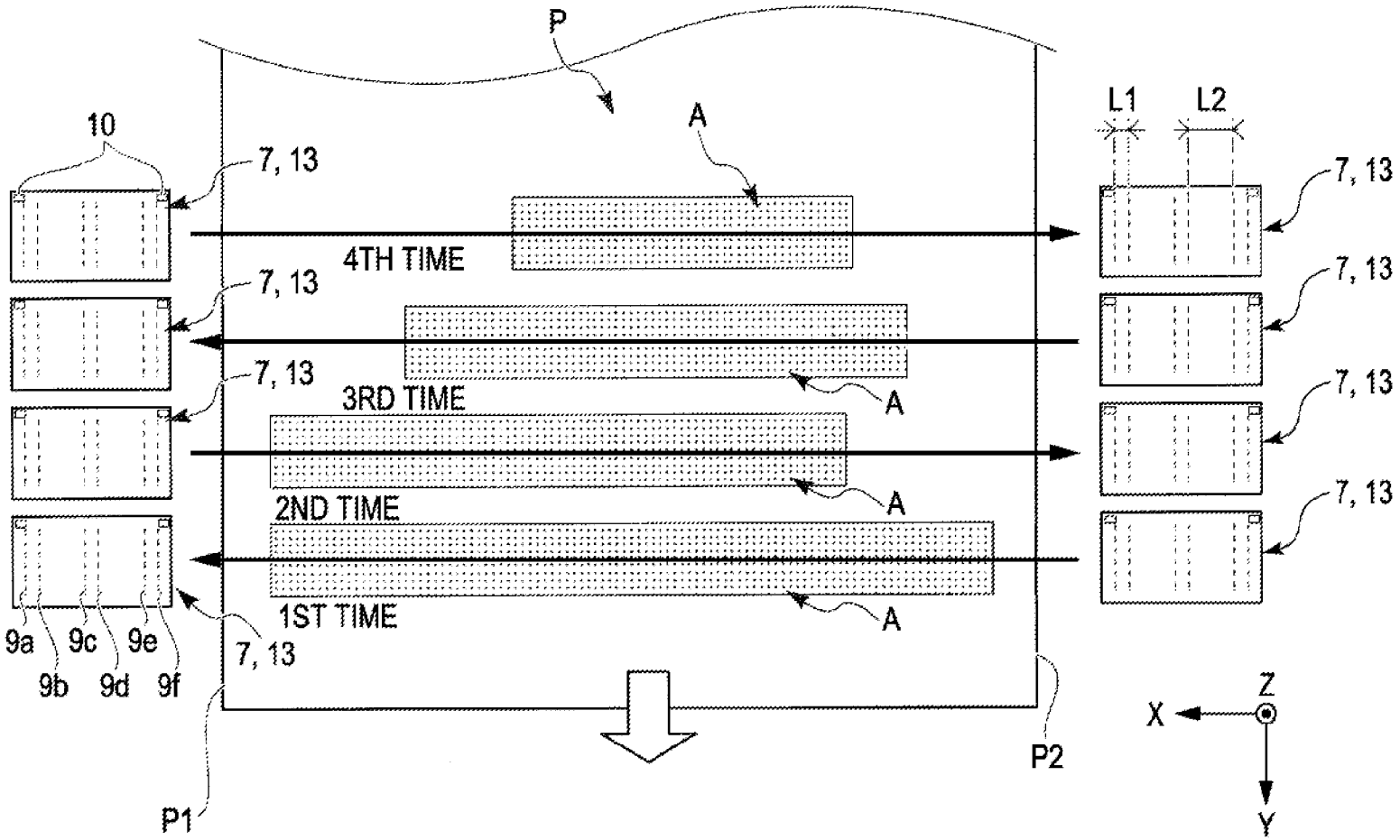
FIG. 3 is a plan view showing an operation of a carriage in a normal recording mode related to the invention.

Shown in FIG. 3 is a plane conceptual view showing an operation of the carriage relative to the paper in a normal recording mode related to the invention.

As shown in FIG. 3, a plurality of rows of nozzles 9 and sensors 10 are provided at the recording head 7. Specifically, from the left side in FIG. 3, a first row of nozzles 9*a*, a second row of nozzles 9*b*, a third row of nozzles 9*c*, a fourth row of nozzles 9*d*, a fifth row of nozzles 9*e*, and a sixth row of nozzles 9*f* are formed.

Of these, each of the distance between the first row of nozzles 9*a* and the second row of nozzles 9*b*, the distance between the third row of nozzles 9*c* and the fourth row of nozzles 9*d*, and the distance between the fifth row of nozzles 9*e* and the sixth row of nozzles 9*f*, is L1. Also, each of the distance between the second row of nozzles 9*b* and the third row of nozzles 9*c*, and the distance between the fourth row of nozzles 9*d* and the fifth row of nozzles 9*e*, is L2. Here, of course, the distances between the rows of nozzles of the first row of nozzles 9*a* to the sixth row of nozzles 9*f* may be equal to each other.

Also, the sensors 10 which can detect the existence or nonexistence of the paper P are provided at both sides in the width direction of the first row of nozzles 9*a* to the sixth row of nozzles 9*f* in the recording head 7. Further, a range A shown in a dot pattern in FIG. 3 is a range which is recorded on the basis of the recording data.

In a case where the normal printing mode is selected, a configuration is made such that a first carriage movement mode is selected which moves the carriage 13 regardless of the position of the range A which is recorded on the basis of the recording data. In other words, a configuration is made such that the stop position of the carriage 13 is determined regardless of the recording start position or the recording end position. Also, a configuration is made such that the stop position of the carriage 13 is determined to be a position where the position of the row of nozzles 9 is further on the outside than both side ends of the paper P. That is, a configuration is made such that the position and the size in the width direction X of the paper P are recognized and a decision is made on the basis of the recognition.

The specific operation will be described below.

The recorded range A in the movement of the first time is the entire range which can be recorded by so-called recording with edge margin, in which recording is not carried out on side ends.

First, in movement (scanning) of the first time of the carriage 13, the carriage 13 moves from the right side to the left side in FIG. 3 as a movement process. At this time, the carriage is accelerated from a state where it has stopped at a position further on the outside than a right side end P2 of the paper P to the left side.

Here, a distance being present between the stop position and the recorded range A is because a given distance is required in order for the carriage 13 to be accelerated up to a given speed and is for making the carriage reach the recorded range A when the given speed has been attained.

Then, as a recording process, recording is started from the right end of the recorded range A and recording is carried out while maintaining a given speed up to the left end of the recorded range A. Thereafter, the carriage 13 decelerates and stops at a position further on the outside than a left side end P1 of the paper P. At this time, the paper P is sent by a given amount to the downstream side (an arrow direction of the Y-axis in FIGS. 1 and 2) in the feed direction.

Also, whether or not the carriage 13 has passed through the right side end P2 and the left side end P1 of the paper P can be determined by the detected state of the paper P by the sensors 10. Additionally, it can also be determined from the drive amount of the first motor (not shown).

Next, in the movement of the second time of the carriage 13, the carriage 13 moves from the left side to the right side in FIG. 3. At this time, the carriage is accelerated from a state where it has stopped at a position further on the outside than the left side end P1 of the paper P to the right side. Then, recording is started from the left end of the recorded range A and recording is carried out up to the right end of the recorded range A. Thereafter, the carriage 13 moves up to the vicinity of the right side end P2 while maintaining a given speed and then the carriage 13 decelerates and stops. The stop position at this time is a position where the position of the row of nozzles 9 is further on the outside than the right side end P2 of the paper P, and is the same as the position where the carriage has stopped before the start of the movement of the first time of the carriage 13.

Subsequently, in the movement of the third time of the carriage 13, the carriage 13 moves from the right side to the left side in FIG. 3. With respect to the manner of the movement of the carriage 13 at this time, it is the same as the manner of the movement of the first time of the carriage 13. However, with respect to the recording execution at this time, since the recorded range A is different from that in the first time, the timing of the recording start and the timing of the recording end are respectively different from the timings in the first time. That is, although the carriage is accelerated in the same way as the first time, moves at a constant speed in the same way, and decelerates and stops in the same way, the timing that the ink is discharged is different from that of the first time.

Further, subsequently, in the movement of the fourth time of the carriage 13, the carriage 13 moves from the left side to the right side in FIG. 3. With respect to the manner of the movement of the carriage 13 at this time, it is the same as the manner of the movement of the second time of the carriage 13. However, with respect to the recording execution at this time, since the recorded range A is different from that the second time, the timing of the recording start and the timing of the recording end are respectively different from the timings in the second time. That is, although the carriage is accelerated in the same way as the second time, moves at a constant speed in the same way, and decelerates and stops in the same way, the timing of that the ink is discharged is different from that in the second time.

Then, since there is no recording data in the movement of the next time of the carriage 13, thereafter, the paper P is sent to the downstream side in the feed direction, thereby being discharged to the discharge stacker of the discharge section.

As described above, in the normal recording mode, the first carriage movement mode is selected. Therefore, even in a case where the recorded range A is changed for each time of scanning, the carriage 13 does not stop at positions where the row of nozzles 9 faces both side ends of the paper P.

Here, in the first carriage movement mode, it is acceptable if the stop position of the carriage 13 is not at a position where the row of nozzles 9 faces both side ends of the paper P. This is for reducing the amount of powdery material adhering to the nozzles. In the normal recording mode, the first carriage movement mode has been described with the stop position of the carriage 13 set to be the position where the position of the row of nozzles 9 is further on the outside than both side ends of the paper P, but the invention is not limited thereto. By broadening the margin that is the edge in the recording with edge margin, it is possible to set the stop position of the carriage 13 to be the position where the position of the row of nozzles 9 is further on the inside than both side ends of the paper P.

As a technical idea, in the first carriage movement mode, it is acceptable if it is possible to maintain a relationship that the stop position of the carriage 13 is a position where the position of the row of nozzles 9 does not face either of both side ends of the paper P. This is for reducing the amount of the powdery material adhering to the nozzles, as described above.

For example, the distance L2 between the second row of nozzles 9*b* and the third row of nozzles 9*c* and the distance L2 between the fourth row of nozzles 9*d* and the fifth row of nozzles 9*e*, which are longer than the distance L1, may also be effectively used.

Specifically, control may be performed such that the carriage 13 stops at a position where the approximate center between the second row of nozzles 9*b* and the third row of nozzles 9*c* or the approximate center between the fourth row of nozzles 9*d* and the fifth row of nozzles 9*e* face both side ends of the paper P.

Shortest Recording Mode: Second Carriage Movement Mode

Figure 4:
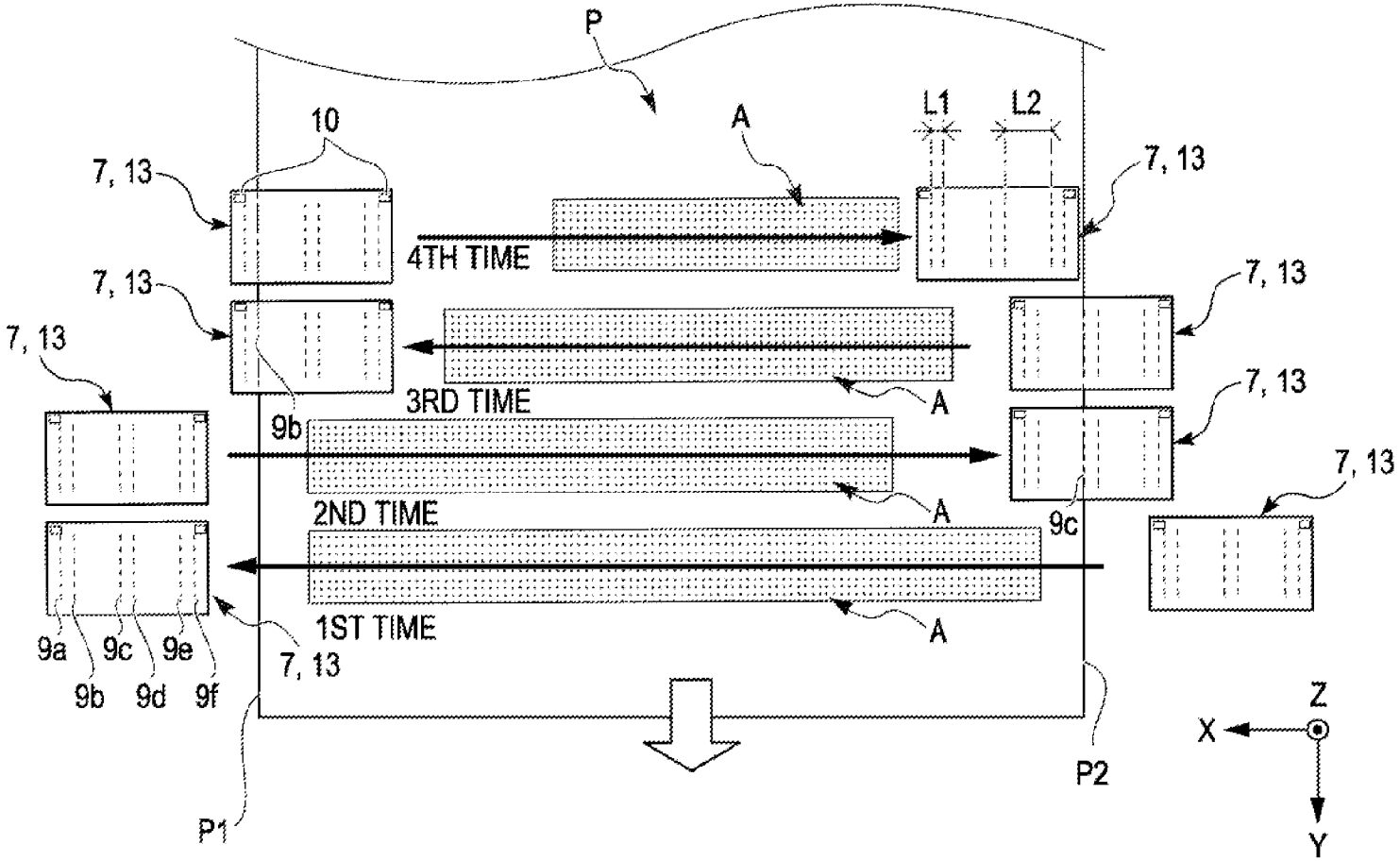
FIG. 4 is a plan view showing an operation of the carriage in the shortest recording mode related to the invention.

Shown in FIG. 4 is a plane conceptual view showing an operation of the carriage relative to the paper in a shortest recording mode related to the invention.

As shown in FIG. 4, in a case where the shortest recording mode is selected, a second carriage movement mode is selected. In the second carriage movement mode, the stop position of the carriage 13 when it has moved in the width direction X at a relevant time is determined in consideration of the recording data in the movement in the width direction X of this time of the carriage 13 and the recording data in the movement in the width direction X of the next time. The range A shown in a dot pattern in FIG. 4 is the range which is recorded on the basis of the recording data.

Also, in order to facilitate comparison of the first carriage movement mode with the second carriage movement mode, the range A which is recorded on the basis of the recording data is set to be the same as that in FIG. 3 described previously.

First, in the movement (scanning) of the first time of the carriage 13, the carriage 13 moves from the right side to the left side in FIG. 4. Here, the recorded range A in the movement of the first time is the entire range which can be recorded by the recording with edge, as described previously. Therefore, with respect to the movement of the first time of the carriage 13, it is the same as that in the case of the above-described normal recording mode. The explanation thereof is omitted.

Next, in the movement of the second time of the carriage 13, the carriage 13 moves from the left side to the right side in FIG. 4. At this time, the carriage is accelerated from a state where the carriage has stopped at a position further on the outside than the left side end P1 of the paper P to the right side. Then, recording is started from the left end of the recorded range A, and recording is carried out while maintaining a given speed up to the right end of the recorded range A. Thereafter, the carriage 13 decelerates and stops.

At this time, the stop position of the carriage 13 is determined in consideration of the range A which is recorded on the basis of the recording data in the movement of the next time, the third time, of the carriage 13. The control section determines whether or not the position of the right end that is an end point of the recorded range A in the movement of the second time of the carriage 13 is further on the left side than the position of the right end that is the start point of the recorded range A in the movement of the next time, the third time, of the carriage 13. That is, whether or not the start position of recording of the next time is further on the downstream side in the direction of the movement of this time of the carriage 13 than the end position of recording of this time is determined.

In this example, as shown in FIG. 4, it is a case where the start position of recording of the third time that is the next time is further on the downstream side in the direction of the movement of this time, the second time, of the carriage 13 than the end position of recording of the second time that is this time. Therefore, the control section performs control such that the carriage stops at a position in which a distance required for acceleration and deceleration is added from the position of the right end of the recorded range A of the next time to the right side. At this time, the paper P is sent by a given amount to the downstream side in the feed direction.

Subsequently, in the movement of the third time of the carriage 13, the carriage 13 moves from the right side to the left side in FIG. 4. At this time, the carriage is accelerated from a state where the carriage has stopped at the stop position determined in the movement of the previous time, the second time, of the carriage 13 to the left side. Then, recording is started from the right end of the recorded range A and recording is carried out while maintaining a given speed up to the left end of the recorded range A. Thereafter, the carriage 13 decelerates and stops. At this time, the stop position of the carriage 13 is determined in consideration of the range A which is recorded on the basis of the recording data in the movement of the next time, the fourth time, of the carriage 13. Similarly to the previous time, whether or not the start position of recording of the fourth time that is the next time is further on the downstream side in the direction of the movement of this time of the carriage 13 than the end position of recording of the third time that is this time is determined.

In this example, as shown in FIG. 4, it is a case where the start position of recording of the fourth time that is the next time is not further on the downstream side in the direction of the movement of this time, the third time, of the carriage 13 than the end position of recording of the third time that is this time. In such a case, the control section performs control such that the carriage stops at a position in which the distance required for acceleration and deceleration is added from the position of the left end of the recorded range A of the third time that is this time to the left side. At this time, the paper P is sent by a given amount to the downstream side in the feed direction.

Further, in the movement of the fourth time of the carriage 13, the carriage 13 moves from the left side to the right side in FIG. 4. At this time, the carriage is accelerated from a state where the carriage has stopped at the stop position determined in the movement of the previous time, the third time, of the carriage 13 to the right side. Then, recording is started from the left end of the recorded range A and recording is carried out while maintaining a given speed up to the right end of the recorded range A. Thereafter, the carriage 13 decelerates and stops. At this time, there is no recording data in the movement of the next time of the carriage 13. In such a case, the control section performs control such that the carriage stops at a position in which the distance required for acceleration and deceleration is added from the position of the right end of the recorded range A of the fourth time that is this time to the right side. Thereafter, the paper P is sent to the downstream side in the feed direction, thereby being discharged to the discharge stacker of the discharge section.

As a result, it is possible to reduce the movement of the carriage 13 when recording is not performed, compared to a control method in which the carriage 13 always moves by a given distance regardless of the range A which is recorded on the basis of the recording data of the next time. That is, it is possible to reduce the wasteful loss of the moving distance and the loss the moving time of the carriage 13.

However, the stop positions of the carriage 13 are different from each other for each movement of the carriage 13, whereby the carriage 13 sometimes stops at a position where that one row of nozzles 9 faces the side end (P1 or P2) of the paper P.

In such a case, similarly to the problems in the related art, there is a risk that the powdery material such as paper dust will adhere to the row of nozzles 9 which is in the facing position. Accordingly, there is a risk that the desired recording quality may not be obtained.

Therefore, the printer 1 of this embodiment is configured so as to select a carriage movement mode as follows.

Figure 5:
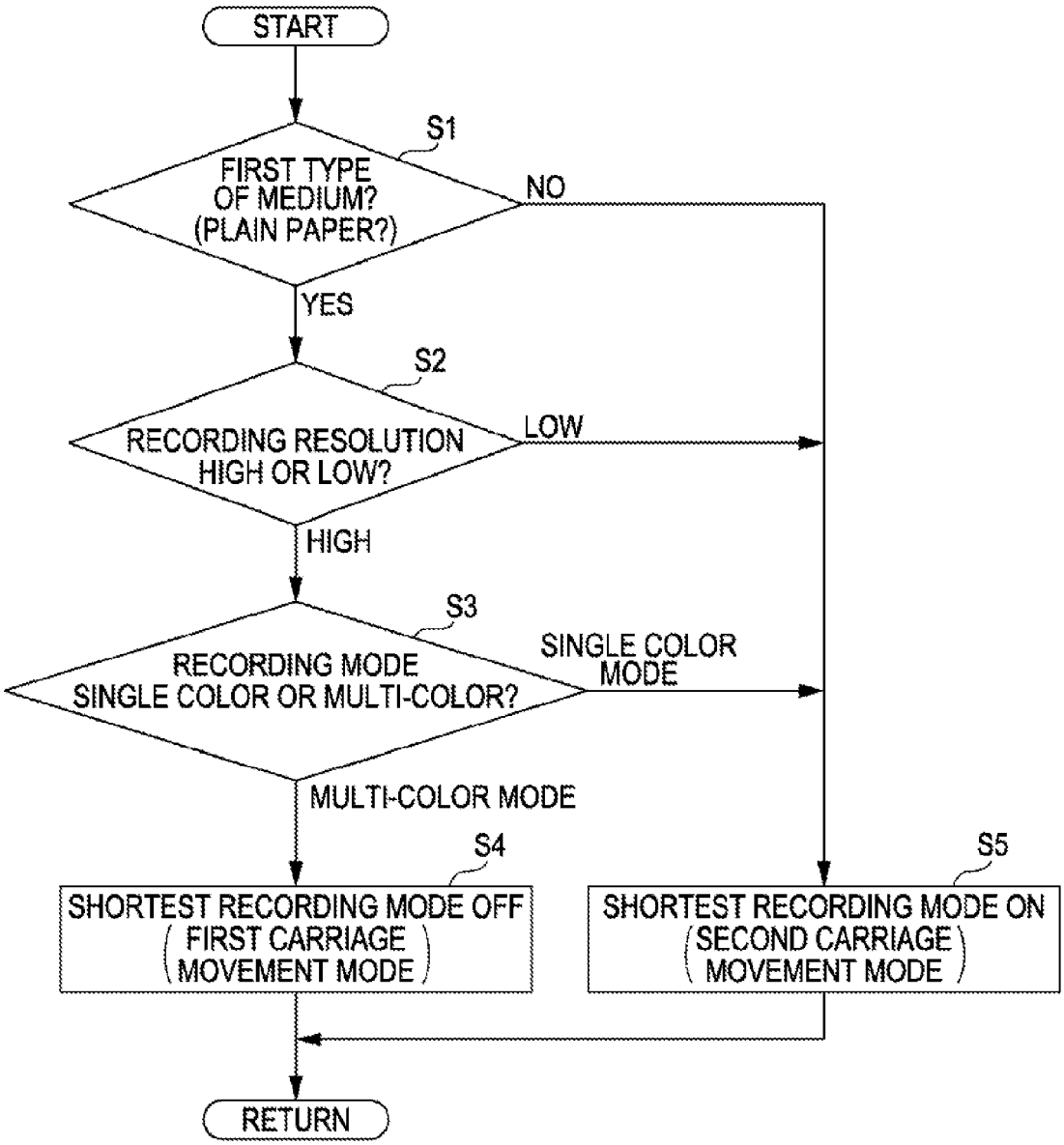
FIG. 5 is a diagram showing a method of selecting a carriage movement mode related to the invention.
Figure 6A:
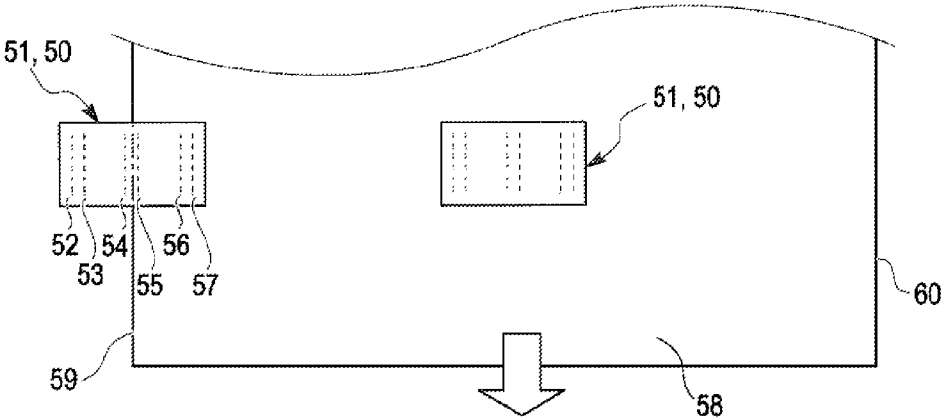
FIGS. 6A to 6C are diagrams showing the amounts of powdery material adhering to recording heads which are shown according to each stop position.
Figure 6B:
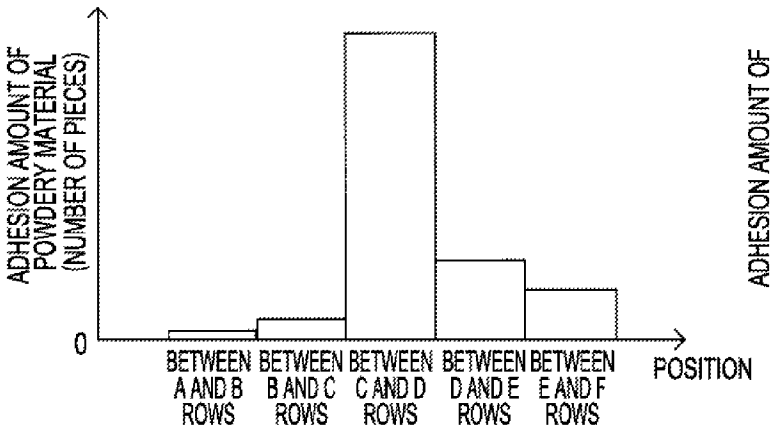
Figure 6C:
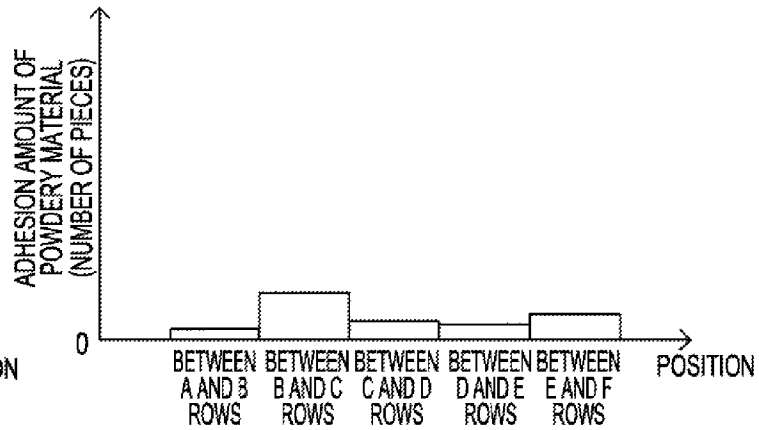

Shown in FIG. 5 is a diagram showing a method of selecting the carriage movement mode related to the invention.

As shown in FIG. 5, in a step S1, the control section determines whether or not a medium which is sent is a first type of medium, as a decision process.

Here, the "first type of medium" means a medium in which the main constituent of a material of the medium is pulp.

Figure 7A:
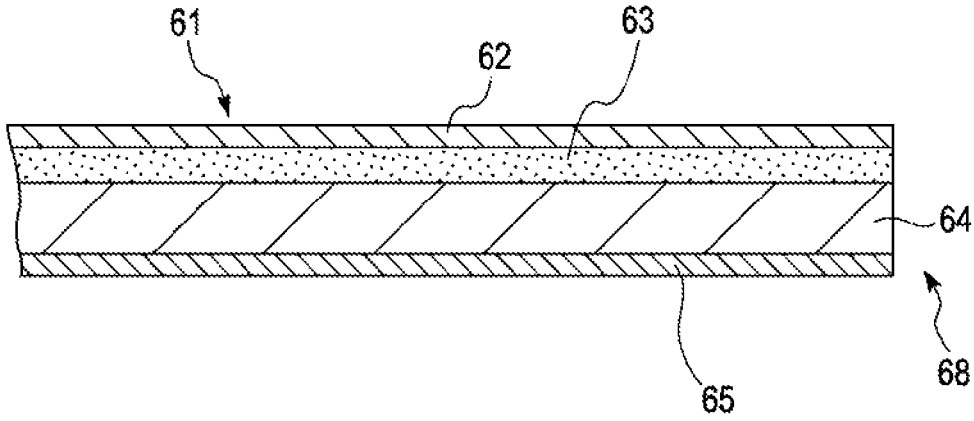
FIGS. 7A and 7B are sectional front views showing the outlines of the structures of photographic paper and plain paper.
Figure 7B:
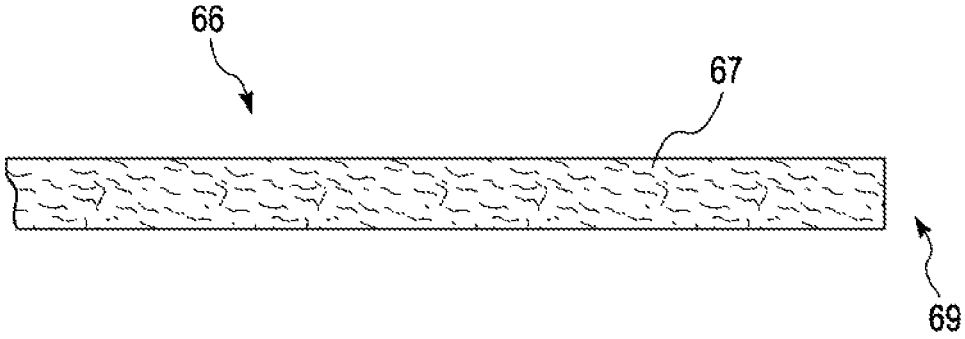

Specifically, whether or not the medium which is sent is the above-described plain paper 66 (refer to FIG. 7B) is determined. Whether or not it is the plain paper 66 can be determined by whether or not the paper P set up in the recording setting of the printer 1 is the plain paper 66. Also, whether the amount of generation of the powdery material is large or small can be determined by using an optical sensor that is one example of a powdery material generation amount measurement section provided in the vicinity of the side end of the paper P further on the upstream side in the feed direction than the recording section 4.

Here, in a case where it is the plain paper 66, since the amount of generation of the powdery material such as paper dust is relatively large, it is preferable to prioritize recording quality over throughput. Therefore, in a case where a decision is made that it is the plain paper 66, the process proceeds to a step S2 in consideration of selection of the first carriage movement mode.

On the other hand, in a case where it is not the plain paper 66, for example, in a case where it is the above-described photographic paper 61 (refer to FIG. 7A), as described previously, the amount of generation of the powdery material such as paper dust is very small. In such a case, even in a case where the shortest recording mode is carried out, there is little fear that recording quality will be lowered due to powdery material. For this reason, it is not necessary to especially prioritize recording quality. Therefore, in a case where a decision is made that it is not the plain paper 66, the process proceeds to a step S5 in order to select the throughput-oriented second carriage movement mode.

In the step S2, the control section determines whether the resolution when carrying out recording on the basis of the recording data is high or low. Specifically, whether or not the value of the resolution is higher than a predetermined threshold value is determined. The "predetermined threshold value" can be set as per requirements.

Here, in a case where the resolution is high, since a high-quality recorded matter is assumed to be required, recording quality is prioritized over throughput. Therefore, in a case where a decision is made that the resolution is high, the process proceeds to a step S3 in consideration of selection of the first carriage movement mode. Also, in a default that is an initial setting in a case where it is the plain paper, the first carriage movement mode is selected.

On the other hand, in a case where the resolution is low, since a high-quality recorded matter is assumed not to be required, throughput is prioritized over recording quality. Therefore, in a case where a decision is made that the resolution is low, the process proceeds to the step S5 in order to select the throughput-oriented second carriage movement mode.

In the step S3, the control section determines whether a recording mode when carrying out recording on the basis of the recording data is a single color mode or a multi-color mode. Specifically, whether a color of recording ink is a single color or two or more colors is determined. The single color mode is a so-called monochrome mode. On the other hand, the multi-color mode is a so-called color mode. Also, in this example, the case of performing recording by using ink of two colors is treated as the color mode (the multi-color mode).

Here, in the case of the color mode, since photographs rather than documents or the like are often recorded, whereby a high-quality recording is often required, recording quality is prioritized over throughput. In the "documents or the like", besides documents, for example, figures expressed by line drawings or the like are included. Therefore, in a case where a decision is made that it is the color mode, the process proceeds to a step S4 in order to select the first carriage movement mode.

On the other hand, in a case where it is the monochrome mode, since documents or the like rather than photographs are often recorded and a high-quality recording is less likely to be required, throughput is prioritized over recording quality. Therefore, in a case where a decision is made that it is the monochrome mode, the process proceeds to the step S5 in order to select the throughput-oriented second carriage movement mode.

In the step S4, the control section selects and carries out the first carriage movement mode as a selection process. For example, the above-described normal recording mode is carried out. Therefore, as described previously, the possibility that the powdery material such as paper dust may adhere to the row of nozzles 9 can be reduced. As a result, a desired high-quality recording can be obtained. Then, the sequence is ended.

In the step S5, the control section selects and carries out the second carriage movement mode as a selection process. Specifically, the above-described shortest recording mode is carried out. As a result, as described previously, throughput can be shortened compared to a case where the normal recording mode is carried out. Then, the sequence is ended.

Also, in the above-described example, the printer itself is configured so as to perform various decisions. However, a configuration may be made such that an external computer performs a decision. For example, a configuration may be made such that a decision is performed by a driver of the computer side connected to the printer 1. This is because also in such a case, the same working effects can be obtained.

Also, in the above-described example, an explanation has been made as a configuration in which the carriage 13 is accelerated from a stopped state, recording is carried out after a state is created where the carriage moves at a constant speed, and thereafter, the carriage decelerates and stops. However, it is not limited thereto. Of course, a configuration is also acceptable in which recording is also carried out during the acceleration and the deceleration of the carriage 13. In the above-described example, an explanation made as a configuration in which recording is not carried out during the acceleration and the deceleration is for easier understanding of the application of this invention.

Further, in the above-described example, whether the recording mode is the single color mode or the multi-color mode is determined. However, a configuration may be made such that whether or not a color is four or more colors such as cyan, magenta, yellow, and black may be determined. In such a case, when a decision is made that it is four or more colors, the first carriage movement mode is selected. On the other hand, when a decision is made that it is less than four colors, the second carriage movement mode is selected. This is because a range capable of reproducing by using subtractive color mixing is expanded by using four colors in which black is added to the three primary colors of cyan, magenta, and yellow colorings and high-quality recording can be carried out. On the other hand, if among the four colors even one color is lacking, the reproducible range is insufficient, whereby it becomes difficult to expect high-quality recording. In such a case, throughput is prioritized.

Also, in the above-described example, an explanation has been made with respect to the so-called two-way pass configuration in which ink is discharged in a forward path and a return path of the movement in the width direction X of the carriage 13. However, it is not limited thereto. A so-called one-way pass configuration is also acceptable in which ink is discharged in only one of the forward path or the return path. It is because also in such a case, by selecting one of either the first carriage movement mode or the second carriage movement mode, it is possible to obtain the same working effects.

Also, in the one-way pass configuration, in the second carriage movement mode, when movement of this time (the n-th time) of the carriage 13 is movement in which discharge of ink is performed, a stop position in the movement of this time (the n-th time) of the carriage 13 is determined on the basis of the end position of recording of this time (the n-th time). In other words, the start position of recording of the next time (the (n+1)th time) is not considered.

On the other hand, when the movement of this time (the n-th time) of the carriage 13 is the movement in which discharge of ink is not performed and movement of the next time (the (n+1)th time) of the carriage 13 is present in the recording data, the stop position in the movement of this time (the n-th time) is determined on the basis of the start position of recording of the next time (the (n+1)th time).

Further, in the above-described example, a configuration is made such that the carriage movement mode is selected according to whether or not the paper P (the medium) which is sent is the plain paper 66. As a technical idea, this is to select the carriage movement mode according to whether or not the powdery material such as paper dust is easily generated on the side end of the paper P. Therefore, a configuration may be made such that the carriage movement mode is selected according to whether or not the main constituent of the paper P (the medium) is pulp. Also, a configuration may be made such that the carriage movement mode is selected according to whether or not the main constituent of the paper P (the medium) is resin. Further, a configuration may be made such that the carriage movement mode is selected according to whether or not the configuration of the paper P (the medium) is a configuration in which a coating process is performed.

For example, in a case where the paper P is a so-called coated paper, the carriage movement mode is selected according to whether an amount of paper dust which is generated is large or small.

Here, the "coated paper" means paper in which a coating process is performed on the plain paper 66 containing pulp as its main constituent, such as higher-grade printing paper or intermediate-grade printing paper. Specifically, it means high-quality coated paper, medium-quality coated paper, or the like.

Whether the used pulp is wood pulp derived from hardwood trees or wood pulp derived from coniferous trees is different according to the makers of the coated papers. Accordingly, as described previously, the amounts of generation of the powdery matter are also different from each other.

Also, even in the coated papers, if coating amounts are different from each other, the amounts of generation of the powdery matter are also different from each other, as described previously. A lightweight coated paper, in which a coating amount is relatively small, has a tendency for the amount of generation of the powdery matter to be larger than the coated paper.

Whether the recording mode is the first carriage movement mode or the second carriage movement mode is selected in consideration of these elements.

The printer 1 that is one example of the liquid ejecting apparatus of this embodiment is characterized by a configuration in which the printer includes the recording head 7 that is one example of a liquid ejecting head having the rows of nozzles 9, each of which is composed of a plurality of nozzles, and discharging ink, that is one example of liquid, from the rows of nozzles 9 onto the paper P, that is one example of a liquid-ejected medium, on the basis of the recording data as liquid ejection data, and the carriage 13 carrying the recording head 7 and moving in the width direction X of the paper P which is sent, wherein the printer has the first carriage movement mode in which the stop position of the carriage 13 in the movement of this time (the n-th time) is determined to be at a given position in the width direction X, on the basis of the size in the width direction X of the paper P regardless of the recording data in the movement of the next time (the (n+1)th time) of the carriage 13, and the second carriage movement mode in which the stop position of the carriage 13 in the movement of this time (the n-th time) is determined on the basis of at least one of the recording data in the movement of this time (the n-th time) and the recording data in the movement of the next time (the (n+1)th time) regardless of the size in the width direction X of the paper P, and recording is carried out with one of the first carriage movement mode and the second carriage movement mode selected in accordance with the type of paper P.

Also, in this embodiment, a feature is a configuration in which in the case of the plain paper 66 that is one example of a first type of medium in which the main constituent of the material of the paper P is pulp, the first carriage movement mode is selected, and in the case of the photographic paper 61 that is one example of a second type of medium in which the main constituent of the material of the paper P is resin, the second carriage movement mode is selected.

Further, in this embodiment, a feature is a configuration in which in the case of the plain paper 66 that is one example of a third type of medium in which the structure of the paper P is a structure in which a coating process is not performed, the first carriage movement mode is selected, and in the case of the photographic paper 61 that is one example of a fourth type of medium in which the structure of the paper P is a structure in which a coating process is performed, the second carriage movement mode is selected.

Also, in this embodiment, a feature is that the given position of the first carriage movement mode is a position where the row of nozzles 9 and the side end in the width direction of the paper P do not face each other.

Further, in this embodiment, a feature is a configuration in which in the case of a configuration in which ink is discharged from the recording head 7 in a forward path and a return path of movement in the width direction X of the carriage 13, in the second carriage movement mode, the stop position in the movement of this time (the n-th time) of the carriage 13 is determined on the basis of one position which is on the downstream side in a moving direction of this time (the n-th time) of the carriage 13 by comparing the start position of recording of the next time (the (n+1)th time) with the end position of recording of the this time (the n-th time), when the movement of the next time (the (n+1)th time) of the carriage 13 is present in the recording data.

Also, a feature is a configuration in which in the case of a configuration in which ink is discharged from the recording head 7 in one of a forward path and a return path of movement in the width direction X of the carriage 13, in the second carriage movement mode, the stop position in the movement of this time (the n-th time) of the carriage 13 is determined on the basis of the end position of recording of the this time (the n-th time) when the movement of this time (the n-th time) of the carriage 13 is the movement in which the discharge of ink is performed, and the stop position in the movement of this time (the n-th time) of the carriage 13 is determined on the basis of the start position of recording of the next time (the (n+1)th time) when the movement of this time (the n-th time) of the carriage 13 is the movement in which the discharge of ink is not performed and the movement of the next time (the (n+1)th time) of the carriage 13 is present in the recording data.

Also, it goes without saying that the movement in either direction in the movement in the width direction of the carriage 13 may be a forward path.

A recording method as a liquid ejecting method in the printer 1 of this embodiment is characterized in that the method includes a movement process for moving the carriage 13 in the width direction X of the paper P, and a recording process as a liquid ejecting process for discharging ink from the rows of nozzles 9 of the recording head 7 provided at the carriage 13 onto the paper P in the movement process, wherein the method further has the first carriage movement mode which determines the stop position of the carriage 13 in the movement of this time (the n-th time) to be at a given position in the width direction X on the basis of the size in the width direction X of the paper P regardless of the recording data in the movement of the next time (the (n+1)th time) of the carriage 13, and the second carriage movement mode which determines the stop position of the carriage 13 in the movement of this time (the n-th time) on the basis of at least one of the recording data in the movement of this time (the n-th time) and the recording data in the movement of the next time (the (n+1)th time) regardless of the size in the width direction X of the paper P, and includes the selection processes (S1, S4, and S5) for selecting one of the first carriage movement mode and the second carriage movement mode in accordance with the type of paper P.

Further, the invention is not limited to the above-described examples, various modifications can be made within the scope of the invention stated in the claims, and it goes without saying that these modifications are also included in the scope of the invention.

What is claimed is:

1. A liquid ejecting apparatus comprising:

a liquid ejecting head that includes nozzles and that ejects liquid from the nozzles onto a liquid-ejected medium on the basis of liquid ejection data;

a carriage that carries the liquid ejecting head and that moves in the width direction of the liquid-ejected medium; and a control section that includes a first carriage movement mode that determines a stop position of the carriage in this movement where the nozzles and a side end in the width direction of the liquid-ejected medium do not face each other, and a second carriage movement mode that determines a stop position of the carriage in this movement including the position where the nozzles and a side end in the width direction of the liquid-ejected medium face each other, and that selects one of the first carriage movement mode or the second carriage movement mode in accordance with the liquid-ejected medium, wherein the control section selects the first carriage movement mode in a case where a first type of medium, in which a main constituent of a material of the liquid-ejected medium is pulp, is selected as the liquid-ejected medium, and selects the second carriage movement mode in a case where a second type of medium, in which a main constituent of the material of the liquid-ejected medium is resin, is selected as the liquid-ejected medium.

2. The liquid ejecting apparatus according to claim 1, wherein the control section selects the first carriage movement mode in a case where a third type of medium, in which a structure of the liquid-ejected medium does not have a coating layer, is selected as the liquid-ejected medium, and selects the second carriage movement mode in a case where a fourth type of medium, in which a structure of the liquid-ejected medium has a coating layer, is selected as the liquid-ejected medium.

3. The liquid ejecting apparatus of claim 1, wherein the control section transports the liquid-ejected medium when the carriage stops at the stop position.

4. A liquid ejecting apparatus comprising:

a liquid ejecting head that includes nozzles and that ejects liquid from the nozzles onto a liquid-ejected medium on the basis of liquid ejection data;

a carriage that carries the liquid ejecting head and that moves in the width direction of the liquid-ejected medium; and a control section that includes a first carriage movement mode which determines a stop position of the carriage in this movement where the nozzles and a side end in the width direction of the liquid-ejected medium do not face each other, and a second carriage movement mode that determines a stop position of the carriage in this movement including the position where the nozzles and a side end in the width direction of the liquid-ejected medium face each other, and that selects one of the first carriage movement mode or the second carriage movement mode, wherein the control section selects the first carriage movement mode in a case where a first type of medium, in which a main constituent of a material of the liquid-ejected medium is pulp, is selected as the liquid-ejected medium, and selects the second carriage movement mode in a case where a second type of medium, in which a main constituent of the material of the liquid-ejected medium is resin, is selected as the liquid-ejected medium.

5. The liquid ejecting apparatus of claim 4, wherein the control section transports the liquid-ejected medium when the carriage stops at the stop position.

6. A liquid ejecting apparatus comprising:

a liquid ejecting head which has nozzles and ejects liquid from the nozzles onto a liquid-ejected medium on the basis of liquid ejection data;

a carriage which carries the liquid ejecting head and moves in the width direction of the liquid-ejected medium; and a control section which has a first carriage movement mode which determines a stop position of the carriage in this movement where the nozzles and a side end in the width direction of the liquid-ejected medium do not face each other, and a second carriage movement mode which determines a stop position of the carriage in this movement including the position where the nozzles and a side end in the width direction of the liquid-ejected medium face each other, and gives priority to the first carriage movement mode over the second carriage movement mode.

7. The liquid ejecting apparatus of claim 6, wherein the control section transports the liquid-ejected medium when the carriage stops at the stop position.

* * * * *